US008153880B2

(12) United States Patent
Sasaki

(10) Patent No.: US 8,153,880 B2
(45) Date of Patent: Apr. 10, 2012

(54) PERFORMANCE APPARATUS AND STORAGE MEDIUM THEREFOR

(75) Inventor: Michihiko Sasaki, Hamamatsu (JP)

(73) Assignee: Yamaha Corporation (JP)

( * ) Notice: Subject to any disclaimer, the term of this patent is extended or adjusted under 35 U.S.C. 154(b) by 481 days.

(21) Appl. No.: 12/057,293

(22) Filed: Mar. 27, 2008

(65) Prior Publication Data

US 2008/0236369 A1 Oct. 2, 2008

(30) Foreign Application Priority Data

Mar. 28, 2007 (JP) ..... 2007-085508

(51) Int. Cl.
*G10H 7/00* (2006.01)

(52) U.S. Cl. ..... 84/612; 84/645

(58) Field of Classification Search ..... 84/612, 84/645; 482/3–9, 900, 901; 700/94
See application file for complete search history.

(56) References Cited

U.S. PATENT DOCUMENTS 4,337,529 A * 6/1982 Morokawa ..... 377/20
4,594,930 A 6/1986 Murakami
4,788,983 A * 12/1988 Brink et al. ..... 600/547
5,215,468 A * 6/1993 Lauffer et al. ..... 434/236
5,256,832 A 10/1993 Miyake
5,267,942 A * 12/1993 Saperston ..... 600/28
5,592,143 A * 1/1997 Romney et al. ..... 340/309.16
5,747,716 A 5/1998 Matsumoto
5,793,739 A 8/1998 Tanaka et al.
5,919,047 A 7/1999 Sone
6,013,007 A * 1/2000 Root et al. ..... 482/8
6,230,047 B1 * 5/2001 McHugh ..... 600/519
6,246,362 B1 * 6/2001 Tsubata et al. ..... 342/357.35
6,344,607 B2 2/2002 Cliff
6,518,492 B2 2/2003 Herberger et al.
6,572,511 B1 * 6/2003 Volpe ..... 482/4
6,607,493 B2 * 8/2003 Song ..... 600/502
6,623,427 B2 * 9/2003 Mandigo ..... 600/300
6,787,689 B1 9/2004 Chen (Continued)

FOREIGN PATENT DOCUMENTS

JP 9-198068 A 7/1997

(Continued)

OTHER PUBLICATIONS

Office Action, mailed on Jan. 27, 2009, issued in corresponding application JP 2007-085508.

(Continued)

*Primary Examiner* — Jeffrey Donels
(74) *Attorney, Agent, or Firm* — Rossi, Kimms & McDowell LLP

(57) ABSTRACT

A performance apparatus capable of reproducing performance data having a desired tempo, even if performance data having the desired tempo is not present in a play list. In a search, a main point value indicated in each of meta data in music information files respectively corresponding to pieces of music registered in the play list is compared with a target tempo value. If the main point value falls within a range in which main point does not vary more than plus or minus 3% from the target tempo value, the music whose main point value is currently compared with the target tempo value is determined as intended music. If the intended music is not present in the play list, music data having the target tempo is automatically produced and reproduced.

6 Claims, 11 Drawing Sheets

U.S. PATENT DOCUMENTS

| | | | | |
|---|---|---|---|---|
| 6,808,473 | B2 * | 10/2004 | Hisano et al. | 482/8 |
| 6,822,153 | B2 | 11/2004 | Comair et al. | |
| 6,933,432 | B2 | 8/2005 | Shteyn et al. | |
| 7,003,122 | B2 * | 2/2006 | Chen | 381/67 |
| 7,026,536 | B2 | 4/2006 | Lu et al. | |
| 7,041,892 | B2 | 5/2006 | Becker | |
| 7,177,672 | B2 * | 2/2007 | Nissila | 600/519 |
| 7,183,479 | B2 | 2/2007 | Lu et al. | |
| 7,207,935 | B1 * | 4/2007 | Lipo | 600/28 |
| 7,534,951 | B2 | 5/2009 | Yamashita | |
| 7,615,702 | B2 | 11/2009 | Becker et al. | |
| 2001/0003542 | A1 * | 6/2001 | Kita | 381/334 |
| 2001/0039872 | A1 | 11/2001 | Cliff | |
| 2002/0043149 | A1 | 4/2002 | Barlay | |
| 2002/0091049 | A1 * | 7/2002 | Hisano et al. | 482/148 |
| 2002/0091796 | A1 * | 7/2002 | Higginson et al. | 709/218 |
| 2003/0037664 | A1 | 2/2003 | Comair et al. | |
| 2003/0183064 | A1 | 10/2003 | Eugene et al. | |
| 2004/0069123 | A1 | 4/2004 | Becker et al. | |
| 2005/0049113 | A1 * | 3/2005 | Yueh et al. | 482/8 |
| 2005/0051021 | A1 | 3/2005 | Laakso | |
| 2005/0126370 | A1 * | 6/2005 | Takai et al. | 84/636 |
| 2005/0129253 | A1 * | 6/2005 | Chen | 381/67 |
| 2005/0141729 | A1 * | 6/2005 | Kanzaki et al. | 381/67 |
| 2006/0048634 | A1 | 3/2006 | Lu et al. | |
| 2006/0084551 | A1 * | 4/2006 | Volpe | 482/8 |
| 2006/0102171 | A1 * | 5/2006 | Gavish | 128/95.1 |
| 2006/0107822 | A1 * | 5/2006 | Bowen | 84/612 |
| 2006/0111621 | A1 * | 5/2006 | Coppi et al. | 600/300 |
| 2006/0112810 | A1 | 6/2006 | Eves et al. | |
| 2006/0169125 | A1 * | 8/2006 | Ashkenazi et al. | 84/612 |
| 2006/0243120 | A1 * | 11/2006 | Takai et al. | 84/612 |
| 2006/0253210 | A1 * | 11/2006 | Rosenberg | 700/94 |
| 2006/0276919 | A1 * | 12/2006 | Shirai et al. | 700/94 |
| 2006/0288846 | A1 * | 12/2006 | Logan | 84/612 |
| 2007/0006708 | A1 | 1/2007 | Laakso | |
| 2007/0027000 | A1 * | 2/2007 | Shirai et al. | 482/8 |
| 2007/0044641 | A1 * | 3/2007 | McKinney et al. | 84/612 |
| 2007/0060446 | A1 * | 3/2007 | Asukai et al. | 482/8 |
| 2007/0074618 | A1 * | 4/2007 | Vergo | 84/612 |
| 2007/0074619 | A1 * | 4/2007 | Vergo | 84/612 |
| 2007/0079691 | A1 * | 4/2007 | Turner | 84/612 |
| 2007/0113725 | A1 * | 5/2007 | Oliver et al. | 84/612 |
| 2007/0169614 | A1 | 7/2007 | Sasaki et al. | |
| 2008/0066609 | A1 * | 3/2008 | Bourgeois | 84/609 |
| 2008/0072741 | A1 * | 3/2008 | Ellis | 84/609 |
| 2008/0190267 | A1 | 8/2008 | Rechsteiner et al. | |
| 2008/0236370 | A1 | 10/2008 | Sasaki | |
| 2008/0314232 | A1 | 12/2008 | Hansson et al. | |
| 2009/0019994 | A1 | 1/2009 | McKinney | |
| 2009/0044689 | A1 | 2/2009 | Komori et al. | |
| 2009/0048694 | A1 | 2/2009 | Matsuda et al. | |
| 2009/0049979 | A1 | 2/2009 | Naik et al. | |
| 2009/0056526 | A1 | 3/2009 | Yamashita et al. | |
| 2009/0133568 | A1 | 5/2009 | Miyajima et al. | |
| 2009/0223352 | A1 | 9/2009 | Matsuda et al. | |
| 2009/0272253 | A1 | 11/2009 | Yamashita et al. | |
| 2010/0031804 | A1 | 2/2010 | Chevreau et al. | |
| 2010/0229094 | A1 | 9/2010 | Nakajima et al. | |
| 2010/0236386 | A1 | 9/2010 | Sasaki | |

FOREIGN PATENT DOCUMENTS

| | | | |
|---|---|---|---|
| JP | 9-230880 | A | 9/1997 |
| JP | 10-11463 | A | 1/1998 |
| JP | 11-3077 | A | 1/1999 |
| JP | 2001-299980 | A | 10/2001 |
| JP | 2007-156280 | A | 6/2007 |

OTHER PUBLICATIONS

Office Action, mailed on Jan. 27, 2009, issued in JP 2007-085509, the corresponding JP application for related co-pending U.S. Appl. Nos. 12/057,317 and 12/794,032.

Office Action, mailed on Jan. 27, 2009, issued in JP 2007-085510, the corresponding JP application for related co-pending U.S. Appl. Nos. 12/057,317 and 12/794,032.

* cited by examiner

PERFORMANCE APPARATUS AND STORAGE MEDIUM THEREFOR

BACKGROUND OF THE INVENTION

1. Field of the Invention

The present invention relates to a performance apparatus for reproducing performance data having a desired tempo, and a computer-readable storage medium storing a program for executing a control method for such a performance apparatus.

2. Description of the Related Art

A performance apparatus for setting a target tempo therein and reproducing performance data having a tempo corresponding to the target tempo is conventionally known.

In some cases, such a performance apparatus is configured that a time-dependent target pulse rate pattern for a time period from start to end of user's exercise is prepared based on exercise intensity or other conditions which are input to the apparatus, the pulse rate of the user performing exercise in time with music is detected, a correction value for correcting the tempo of music data is calculated based on the user's exercise tempo and a difference between the target and detected pulse rates, and the tempo of the music data is corrected with the correction value (for example, see Japanese Laid-open Patent Publication No. 2001-299980).

There is also known a performance apparatus, in which a list of pieces of music (play list) matching various conditions set therein is prepared, and when any of the set conditions is changed, the play list is automatically renewed such as to make pieces of music in the play list conform to the changed conditions.

A combination of the above described known apparatuses suggests a performance apparatus for reproducing performance data selected from a play list prepared based on various conditions set by a user. In the suggested performance apparatus, a correction value for correcting the tempo of currently reproduced performance data is calculated based on user's exercise tempo and a difference between target and detected pulse rates. If performance data having a desired tempo corresponding to the tempo corrected with the correction value is present in the play list, a shift is made from the reproduction of the currently reproduced performance data to the reproduction of performance data having the desired tempo. If such performance data is not present in the play list, on the other hand, performance data having a tempo closest to the corrected tempo is selected from the play list, and the selected performance data is reproduced after its original tempo is corrected.

With the above described performance apparatus corresponding to a combination of the conventional apparatuses, if there is no performance data having a desired tempo corresponding the corrected tempo in the play list, some other performance data selected from the play list is reproduced after its original tempo is corrected. Thus, the selected performance data is unnaturally reproduced at a tempo different from its original tempo. Especially in the case of the performance data being audio data, which cannot freely be changed in tempo unlike MIDI (Musical Instrument Digital Interface) data, it is necessary to perform cumbersome processing on the audio data to change the tempo thereof. In addition, music tones resulting from the reproduction of audio data with its original tempo changed are quite unnatural when heard.

In the latter of the above described conventional performance apparatuses in which the play list is prepared in accordance with various set conditions, performance data changed to meet performance data selection conditions is automatically added to the play list, whereas performance data no longer met the selection conditions is automatically erased from the list. On the other hand, the selection conditions per se can be set only by a user by performing a setting operation. In other words, the selection conditions are not automatically renewed, and therefore, user's evaluation to music sound reproduced from performance data is not automatically fed back to the selection conditions.

SUMMARY OF THE INVENTION

The present invention provides a performance apparatus capable of reproducing performance data having a desired tempo, even if there is no performance data having the desired tempo in a play list, and a computer-readable storage medium storing a program for executing a control method for such a performance apparatus.

The present invention also provides a performance apparatus capable of automatically feeding user's evaluation to music sound reproduced from performance data back to conditions for performance data selection, and a computer-readable storage medium storing a program for executing a control method for such a performance apparatus.

According to a first aspect of this invention, there is provided a performance apparatus comprising a storage unit adapted to store a plurality of performance data, a setting unit adapted to set a target tempo, a search unit adapted to, from among the plurality of performance data stored in the storage unit, search for intended performance data having a tempo falling within a predetermined range including the target tempo set by the setting unit, a selection unit adapted to, if intended performance data has been found by the search unit, select the intended performance data, and adapted to, if the intended performance data has not been found, produce all new performance data having a tempo corresponding to the set target tempo and select the produced performance data, and a reproduction unit adapted to reproduce the performance data selected by the selection unit.

According to a second aspect of this invention, there is provided a performance apparatus comprising a transmitter-receiver unit adapted to transmit and receive data to and from an external device connected thereto, a notification unit adapted to notify the external device of a tempo range via the transmitter-receiver unit, a storage unit adapted to receive performance data from the external device via the transmitter-receiver unit and store the received performance data, a reproduction unit adapted to reproduce the performance data, and a changing unit adapted to change the tempo range in accordance with an instruction given by user's operation.

According to a third aspect of this invention, there is provided a performance apparatus comprising a transmitter-receiver unit adapted to transmit and receive data to and from an external device connected thereto, a notification unit adapted to notify the external device of a tempo range via the transmitter-receiver unit, a storage unit adapted to receive performance data from the external device via the transmitter-receiver unit and store the received performance data, a setting unit adapted to set a target tempo, a search unit adapted to search for, from among a plurality of performance data stored in the storage unit, intended performance data having a tempo falling within a predetermined range including the target tempo set by the setting unit, a selection unit adapted to, if the intended performance data has been found by the search unit, select the intended performance data, and adapted to, if the intended performance data has not been found, produce performance data having a tempo corresponding to the set target tempo and select the produced performance data, a reproduction unit adapted to reproduce the performance data selected by the selection unit, and a tempo range changing unit adapted to change the tempo range when the target tempo changed by the target tempo changing unit falls outside the tempo range.

According to a fourth aspect of this invention, there is provided a computer-readable storage medium storing a program for causing a computer to execute a method for controlling a performance apparatus including a storage unit, the method comprising a setting step of setting a target tempo, a search step of searching for, from among a plurality of performance data stored in the storage unit, performance data having a tempo falling within a predetermined range including the target tempo set in the setting step, a selection step of selecting intended performance data, if the intended performance data has been found in the search step, the selection step producing all new performance data having a tempo corresponding to the set target tempo and selecting the produced performance data, if the intended performance data has not been found, and a reproduction step of reproducing the performance data selected in the selection step.

According to a fifth aspect of this invention, there is provided a computer-readable storage medium storing a program for causing a computer to execute a method for controlling a performance apparatus including a storage unit and a transmitter-receiver unit for transmitting and receiving data to and from an external device connected thereto, the method comprising a notification step of notifying the external device of a tempo range via the transmitter-receiver unit, a storage step of receiving performance data from the external device via the transmitter-receiver unit and storing the received performance data, a reproduction step of reproducing performance data, and a changing step of changing the tempo range in accordance with an instruction given by user's operation.

With the present invention, a plurality of performance data stored in the storage unit are searched for to find intended performance data having a tempo falling within a predetermined range including a target tempo, and if the intended performance data has not been found, all new performance data having a tempo corresponding to the target tempo is produced and reproduced. Therefore, performance data having the desired tempo can be reproduced, even if such a performance data is not stored in the storage unit.

With this invention, the tempo range notified to the external device via the transmitter-receiver unit and referred to by the external device upon selection of performance data is changed in accordance with an instruction given by user's operation. Thus, user's evaluation to music sound reproduced from performance data can be fed back to conditions for selection of performance data.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1:
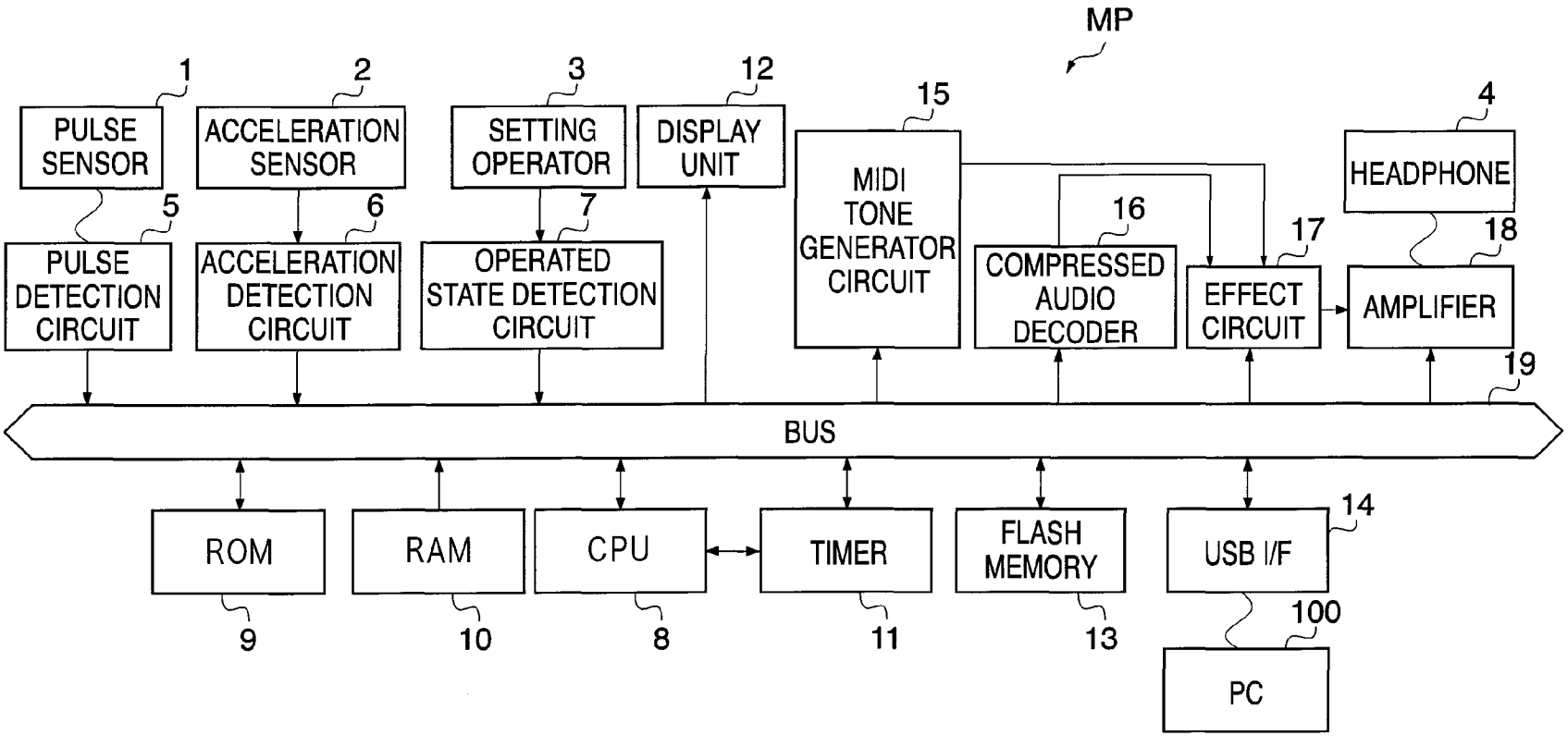
FIG. 1 is a block diagram schematically showing the construction of a portable music player to which a performance apparatus according to one embodiment of this invention is applied.

FIG. 1 schematically shows in block diagram the construction of a portable music player MP to which a performance apparatus according to one embodiment of this invention is applied.

As shown in FIG. 1, the music player MP includes a pulse sensor 1 for detecting a user's pulse, an acceleration sensor 2 for detecting a user's exercise state, a setting operator 3 including a plurality of switches, a headphone 4, a pulse detection circuit 5 for detecting a pulse based on an output from the pulse sensor 1, an acceleration detection circuit 6 for detecting x-, y- and z-axis direction accelerations based on an output from the acceleration sensor 2, an operated state detection circuit 7 for detecting operated states of the respective switches of the setting operator 3, a CPU 8 for controlling the entire apparatus, a ROM 9 for storing control programs executed by the CPU 8, various table data, etc., a RAM 10 for temporarily storing music data, various input information, computation results, etc., a timer 11 for measuring an interrupt time period for timer interrupt processing and various time periods, a display unit 12 for displaying various information, etc., which is comprised, for example, of a liquid crystal display (LCD), light emitting diodes (LEDs), and the like, a flash memory 13 for storing various application programs including the control programs, various music data, various data, etc., an USB I/F (universal serial bus interface) 14 for transmitting and receiving data to and from a PC (personal computer) 100 which is an external device connected thereto, a MIDI tone generator circuit 15 for converting music data consisting of MIDI data among the stored music data into musical tone signals, a compressed audio decoder 16 for expanding and converting music data consisting of compressed audio data among the stored music data into musical tone signals, an effect circuit 17 for adding various effects on musical tone signals which are output from the MIDI tone generator circuit 15 and the compressed audio decoder 16, and an amplifier 18 for amplifying musical tone signals supplied from the effect circuit 17.

The above described elements 5 to 18 are connected to a bus 19. The MIDI tone generator circuit 15 and the compressed audio decoder 16 are connected to the effect circuit 17 which is connected to the amplifier 18. The headphone 4 is connected to the amplifier 18.

The pulse sensor 1 is attached to user's earlap, hand, finger, or the like, and adapted to output a signal in synchronism with the user's pulse. In this embodiment, the pulse sensor 1 is provided in an earmuff part of the headphone 4 for detection of the user's pulse. Needless to say, the pulse sensor 1 may be attached to or provided in any other part than headphone earmuff so long as it can detect the pulse without hindering user's exercise.

The acceleration sensor 2 is provided in a housing of the music player MP. Since the music player MP is attached to the user's waist or the like as described below, vertical and horizontal accelerations are produced in the music player MP while the user is performing exercise, and are detected by the acceleration sensor 2. It should be noted that the acceleration sensor 2 is not limited to being incorporated in the music player MP, but may be configured separately from the music player MP.

The flash memory 13 can be adapted to store control programs for execution by the CPU 8, as described above. In the case of such control programs not being stored in the ROM 9, the control programs can be stored in the flash memory 13. By reading the control programs from the flash memory 13 into the RAM 10, it is possible to cause the CPU 8 to make actions similarly to the case where the control programs are stored in the ROM 9. In that case, the control programs can easily be added and version upgraded.

Figure 2A:
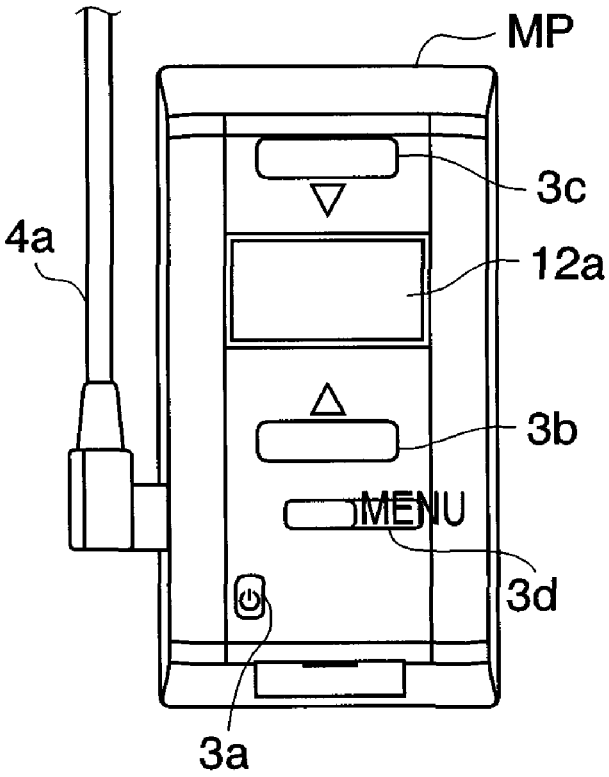
FIG. 2A is a view showing the external appearance of the musical player schematically shown in FIG. 1.
Figure 2B:
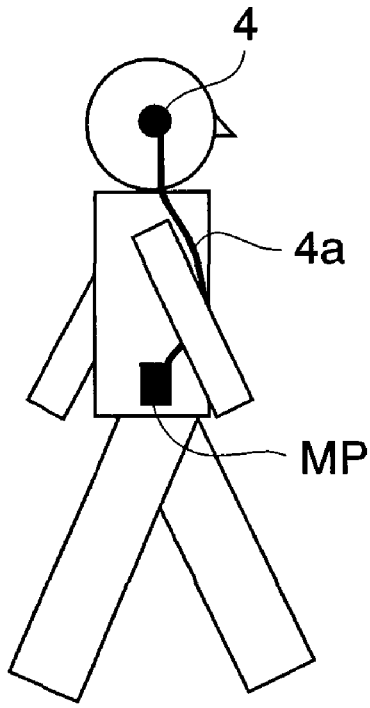
FIG. 2B is a view showing an example of how the music player is attached to user's body.

FIGS. 2A and 2B respectively show the external appearance of the music player MP and an example of how the music player MP is attached to user's body.

As shown in FIG. 2A, a plurality of switches 3*a* to 3*d* and an LCD 12*a* are provided in a panel surface of the music player MP. The switch 3*a* is a power button for turning on and off the power supply, the switch 3*b* is apace-up button for speeding up the music tempo to speed up the exercise pace, the switch 3*c* is a pace-down button for slowing down the music tempo to slow down the exercise pace, and the switch 3*d* is a menu button to cause a menu to be displayed on the LCD 12*a*. Menu items and parameters can be selected by the switches 3*b* and 3*c*. By simultaneously pressing the switches 3*b* and 3*c*, the user can give the music player MP instructions for approval, reproduction, and stop. The headphone 4 is connected via a cable 4*a* to a headphone jack (not shown) which is connected to the amplifier 18.

The music player MP is attached to the user's waist via a belt, for example. FIG. 2B shows an example of how the music player MP is attached to the user's waist. The music player MP can be, of course, attached to any part of the user's body other than the waist. In this embodiment, the music player MP is for assisting the user's exercise, and therefore, the music player MP should be attached to a body part where it does not hinder the user's exercise.

Figure 3:
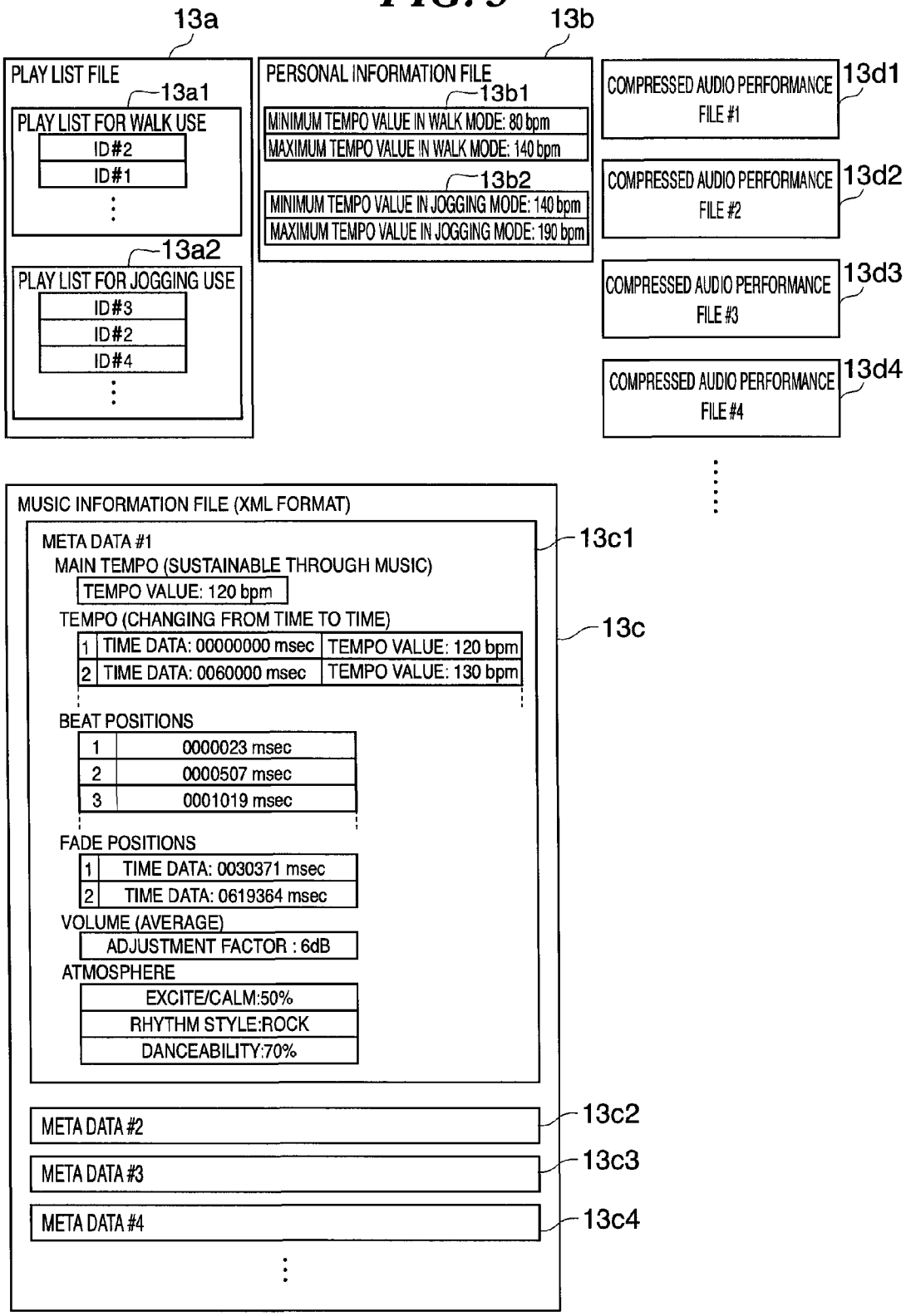
FIG. 3 is a view showing a part of files stored in a flash memory shown in FIG. 1.

FIG. 3 shows a part of data stored in the flash memory 13. In FIG. 3, a play list file 13*a*, a personal information file 13*b*, a music information file 13*c*, and compressed audio performance files 13*dn* (n=1, 2, . . . ) are shown as a part of the data.

The play list file 13*a* includes a play list 13*a*1 for walk use and a play list 13*a*2 for jogging use. Each of the play lists is a tabulated list in which pieces of reproducible (performable) music are listed. In some music player other than the music player MP of this embodiment, pieces of reproducible music and the order of reproduction thereof are listed in the play list. On the other hand, in the play list of this embodiment, pieces of reproducible music are only listed, with the order of reproduction thereof omitted. The play list 13*a*1 for walk use is a tabulated list in which pieces of music selected for use in walk mode are included, whereas the play list 13*a*2 for jogging use is a tabulated list in which pieces of music selected for use in jogging mode are included. In the play lists of this embodiment, IDs assigned to respective pieces of music (compressed audio performance files 13*dn*) are registered, but this is not limitative. Alternatively, names or any others may be registered so long as respective pieces of music can be specified. In this embodiment, there are only shown two types of operation modes, i.e., the walk mode and the jogging mode, for the sake of simplified explanation. Actually, however, there are provided operation modes in a number corresponding to the number of types of exercise (normally, about ten types).

Like the play list file 13*a*, the personal information file 13*b* includes a plurality of types of personal information for selection according to the operation modes. In this embodiment, the personal information file 13*b* includes personal information 13*b*1 for walk mode and personal information 13*b*2 for jogging mode. Specifically, each personal information is a tempo range specified by minimum and maximum tempo values. Each tempo range is used to select, from among performance files 13*dn*, personal files to be registered in the play list concerned. Specifically, performance files selected from the performance files 13*dn* are registered in the play list 13*a*1 for walk use, wherein each of the selected performance files has a tempo value (=a tempo value of main point) falling within a range from 80 bpm (=the minimum tempo value in walk mode) to 140 bpm (=the maximum tempo value in walk mode). On the other hand, performance files each having a tempo value (=a tempo value of main point) falling within a range from 140 bpm (=the minimum tempo value in jogging mode) to 190 bpm (=the maximum tempo value in jogging mode) and selected from the performance files 13*dn* are registered in the play list 13*a*2 for jogging use.

The music information file 13*c* includes pieces of meta data 13*cn* (n=1, 2, . . . ) respectively corresponding to the performance files 13*dn*. Each of the pieces of meta data 13*cn* includes a main point which remains substantially unchanged through the music concerned, tempos which change from time to time, beat positions, fade positions, and so on, which are registered therein. It should be noted that, among the above described parameters registered in meta data 13*cn*, the main point directly relates to this invention. The main point is a value representing a tempo that is most sustainable through the entire music, and is a tempo value that represents the entire music.

The performance files 13*dn* each consist of compressed audio performance data. Any method can be used for audio performance data compression. There may be mentioned, for example, MP3 (MPEG audio layer 3), WMA (Windows (registered trademark) media audio), AAC (advanced audio coding), etc. Compressed audio performance data on which the performance files 13*dn* are based are acquired by the PC 100, as described below with reference to FIG. 7. Upon acquisition of compressed audio performance data, the PC 100 analyzes the content of the data, and produces meta data corresponding to the compressed audio performance data.

Figure 4:
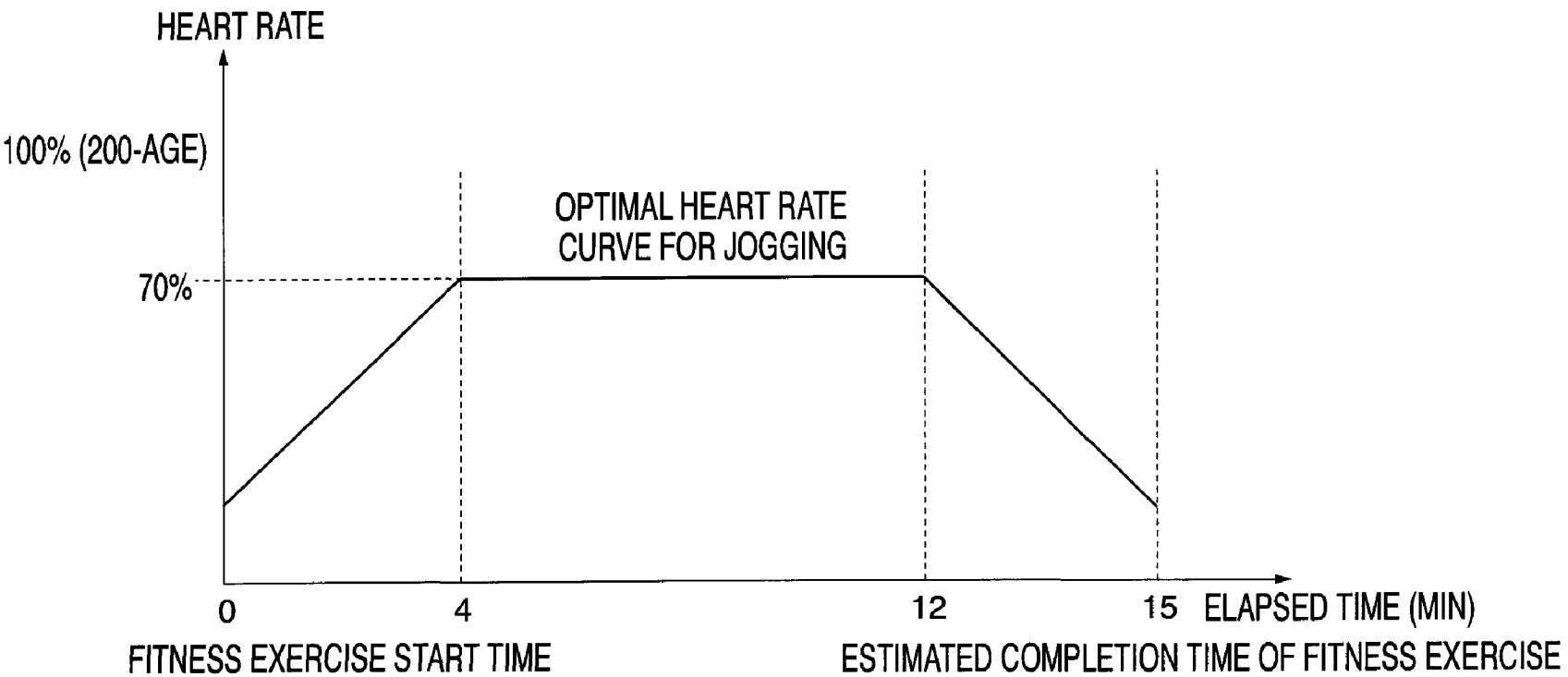
FIG. 4 is a view showing an example of an optimal heart rate curve in a jogging mode.

In the following, a control process executed by the music player MP constructed as described above will be schematically described with reference to FIG. 4, and then described in detail with reference to FIGS. 5 to 10.

The music player MP mainly carries out the following processes.

(A) A music selection/reproduction process, in which pieces of music are selected and reproduced such as to change the user's heart rate along an optimal heart rate curve; and (B) A pace change process to change the exercise pace in accordance with user's operations of the pace up/down buttons 3*b*, 3*c*.

When an instruction to start fitness exercise is given by the user to the music player MP, the CPU 8 causes the process to proceed to the music selection/reproduction process (A) in which an optimal heart rate curve is calculated based on current settings. It is assumed here that the jogging mode has been set as the operation mode. FIG. 4 shows an example of the optimal heart rate curve calculated in a state that the jogging mode is set. Next, the CPU 8 sets an initial value of the target tempo to the minimum tempo value in the jogging mode, i.e., 140 bpm (see FIG. 3), searches for music having a tempo corresponding to the target tempo from the play list 13*a*2 for jogging use. As a result of the search, if intended music is present in the play list 13*a*2 for jogging use, the CPU 8 selects the intended music, i.e., one of the compressed audio performance files 13*dn* (n=1, 2, . . . ), and gives an instruction to reproduce the selected music to the compressed audio decoder 16. On the other hand, as a result of the search, if the intended music is not present in the play list 13*a*2 for jogging use, the CPU 8 produces, in the MIDI data format, music having a tempo corresponding to the target tempo, selects the produced music data, and gives an instruction to reproduce the produced music data to the MIDI tone generator circuit 15. As described above, if music having a tempo corresponding to the target tempo is not registered in the play list, music data having a tempo corresponding to the target tempo is newly produced and reproduced. Therefore, reproduced music sound is quite natural when heard.

When the selected music data is continued to be reproduced for a predetermined time period (30 seconds, for example), the CPU 8 detects user's pulse (=heart rate) via the pulse detection circuit 5, and calculates a difference between the detected heart rate and a target heart rate (i.e., a heart rate on the optimal heart rate curve at a given elapsed time from the start of fitness exercise). If the difference between the detected and target heart rates falls outside a predetermined range (in which the difference does not vary more than plus or minus 3% from the target heart rate, for example), the CPU 8 changes the target tempo such as to decrease the difference therebetween. Specifically, when the detected heart rate is more than 3% larger than the target heart rate, the CPU 8 decreases the target tempo by 5%. On the other hand, when the detected heart rate is more than 3% smaller than the target heart rate, the target tempo is increased by 5%. Then, the CPU 8 newly selects music in accordance with the target tempo having been changed as described above. As a result, the target tempo is adjusted such that the user's heart rate is made along the optimal heart rate curve, and pieces of music each having a tempo corresponding to the target tempo are selected and reproduced in sequence until completion of the fitness exercise.

When the pace up/down button 3*b* or 3*c* is operated by the user during the fitness exercise, the CPU 8 causes the process to proceed to the pace change process (B), in which the target tempo is increased or decreased by a predetermined value (5%, for example). Then, the CPU 8 determines whether or not the pace up/down button 3*b* or 3*c* has been operated in predetermined timing. If it is determined that the button has been operated in the predetermined timing, the personal information 13*b*2 is changed. The predetermined timing and the content of information renewal are as follows:

(a) The minimum tempo value is renewed to an increased/decreased target tempo in the case that the pace up/down button 3*b* or 3*c* has been operated within 30 seconds from the start of fitness exercise; and (b) The maximum tempo value is renewed to an increased or decreased target tempo in the case that the pace-down button 3*c* has been operated after elapse of 30 seconds from the start of fitness exercise and as a result the target tempo has been decreased to below the maximum tempo value or in the case that the pace-up button 3*b* has been operated after elapse of 30 seconds from the start of fitness exercise and as a result the target tempo has exceeded the maximum tempo value.

It should be noted that the above described timing and the content of renewal are shown only for illustrative purpose and not limitative. Based on the changed target tempo, the CPU 8 newly selects pieces of music. As a result, in accordance with the user's instruction, the newly selected pieces of music having tempos different from those of previously selected music are reproduced in sequence. The personal information concerned is also renewed in predetermined timing. As described above, the personal information is used for selection of music data, which are to be registered into the play list concerned. Therefore, in the next exercise (which should be performed after the play list has been renewed), the user is capable of performing exercise in time to the music reproduced based on pieces of music data, which are selected from music data each having a tempo falling within the tempo range specified by the user. In other words, evaluation to performance data by the user having heard music reproduced therefrom in the immediately preceding exercise can automatically be fed back to conditions for performance data selection.

Next, the control process is explained in detail.

Figure 5A:
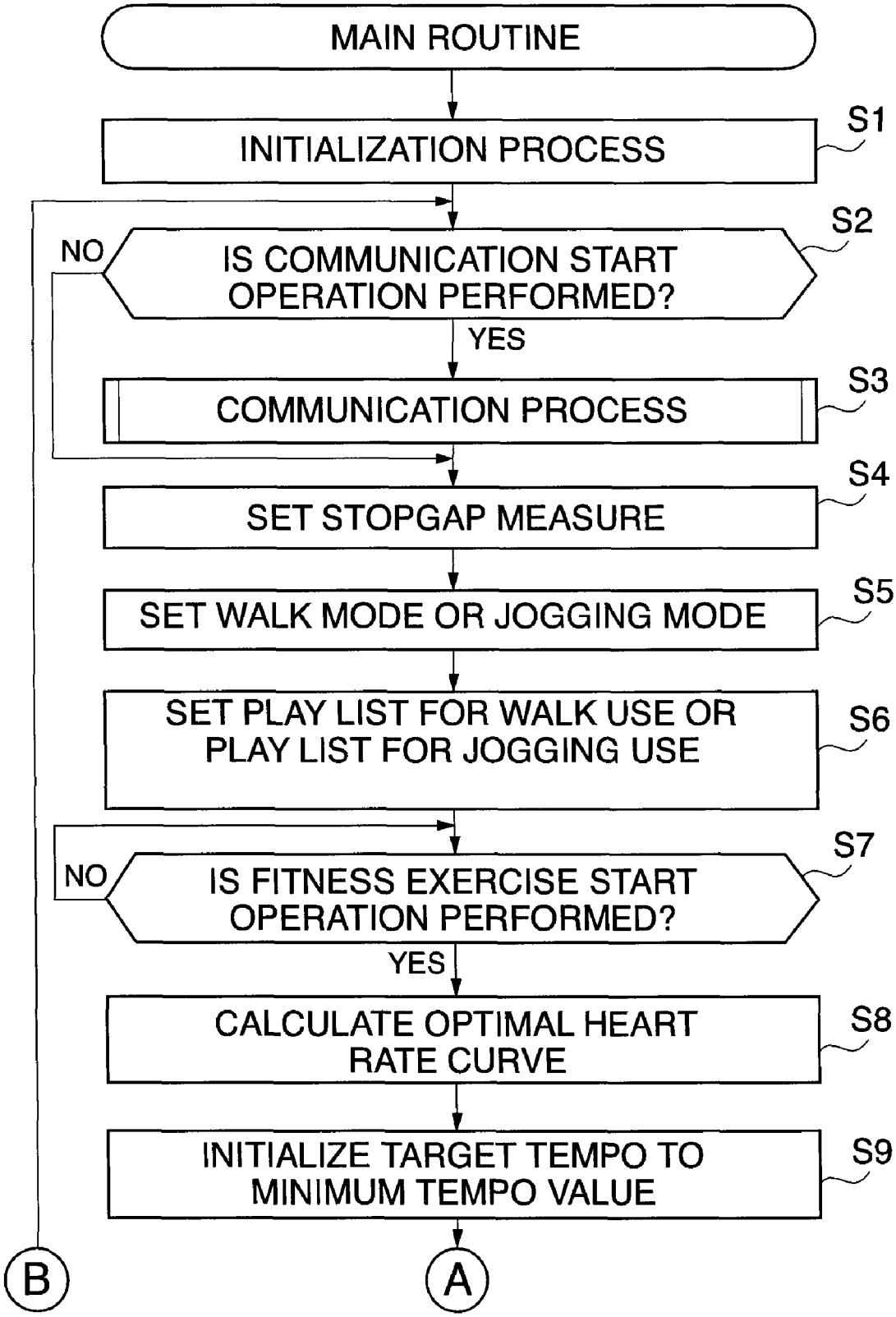
FIGS. 5A and 5B are a flowchart showing the procedure of a main routine executed by the music player shown in FIG. 1, particularly by a CPU thereof.
Figure 5B:
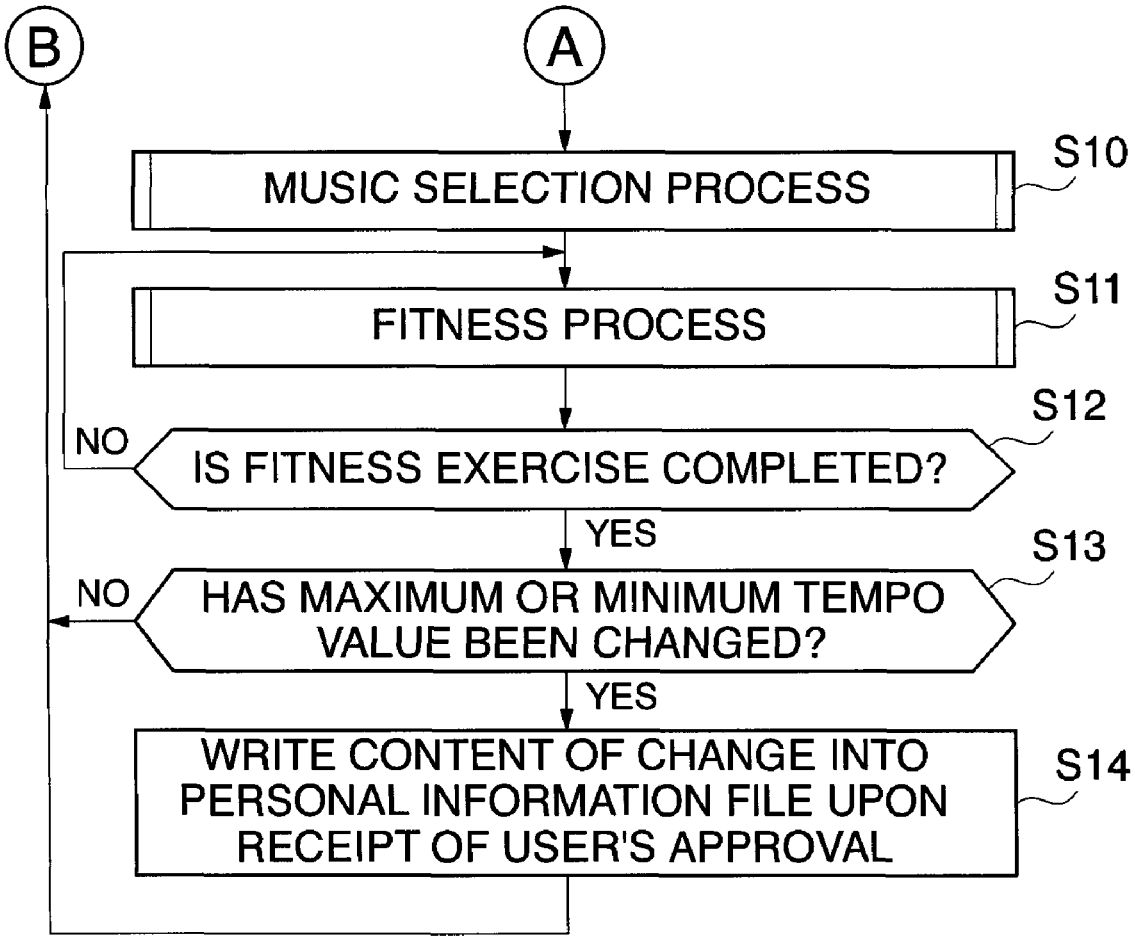

FIGS. 5A and 5B show in flowchart the procedure of the main routine executed by the music player MP, especially, by the CPU 8 thereof.

In the main routine, the CPU 8 mainly performs the following processes.

(1) An initialization process (step S1);

(2) A communication process with the PC 100 (step S3);

(3) A process before the start of fitness exercise (steps S4 to S6);

(4) A process at the start of fitness exercise (steps S8 to S10);

(5) A fitness process (step S11); and (6) A process upon completion of fitness exercise (steps S13 and S14).

The main routine is started when power is turned on by the power button 3*a*. Upon start of the main routine, the initialization process (1) is executed once. Subsequently, the processes (2) to (6) are executed in sequence. When the process (6) is completed, the process is returned to the process (2). Then, the processes (2) to (6) are repeatedly carried out until the power is turned off by the power button 3*a*.

In the initialization process (1), the CPU 8 performs initialization to clear the RAM 6 and sets various parameter values to default values, and so on. Initialization for the operation mode is also performed to set the walk mode, for example, as a default operation mode.

When a communication start operation, such as connecting the USB I/F 14 to the PC 100 via, for example, the USB cable (not shown), is performed by a user (step S2 in FIG. 5A), the CPU 8 detects that the PC 100 is connected to the USB I/F 14 and causes the process to proceed to the communication process (2).

Figure 6:
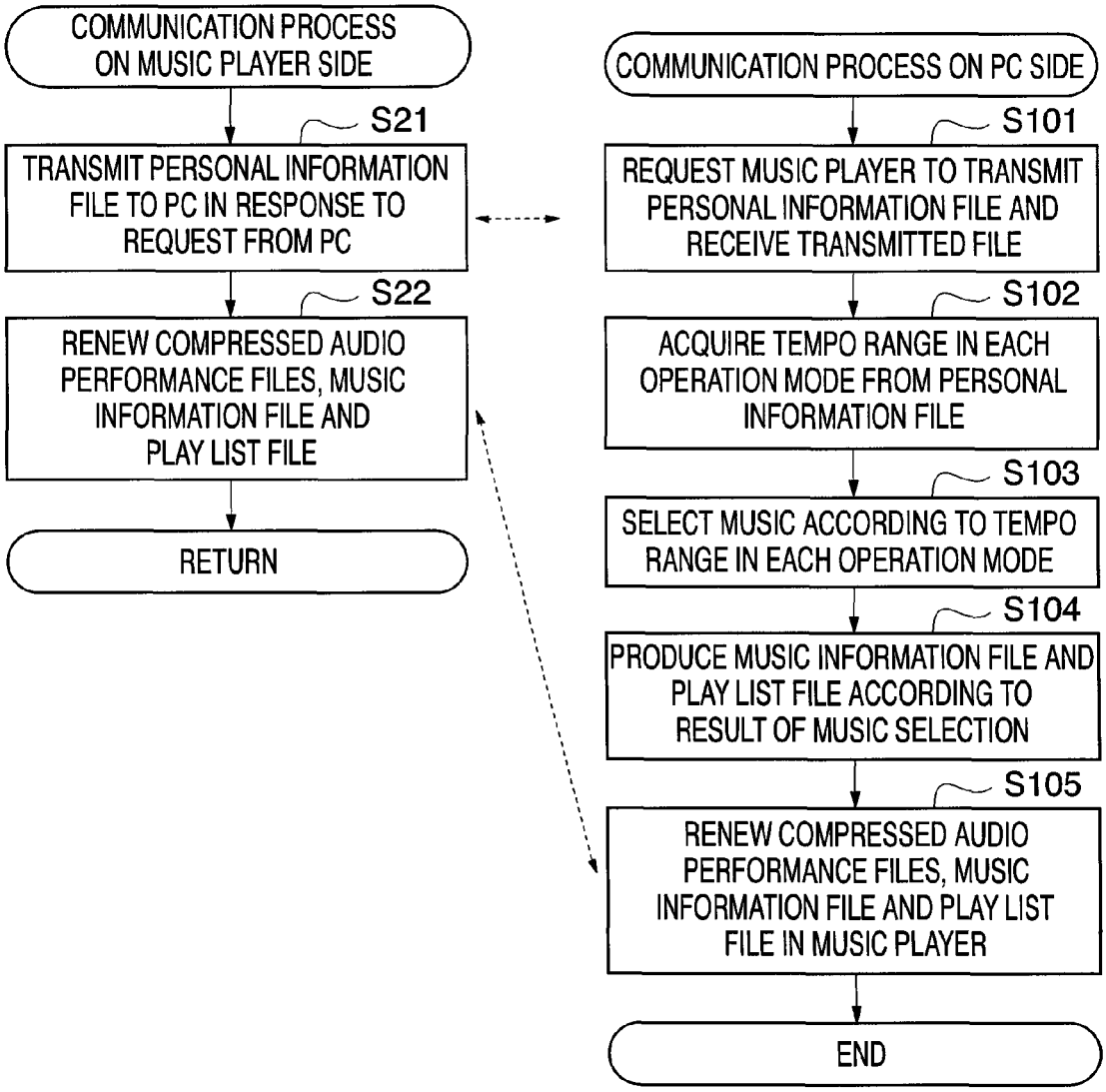
FIG. 6 is a flowchart showing in detail the procedure of a communication process shown in FIG. 5A.

FIG. 6 shows in flowchart the procedure of the communication process in detail. In FIG. 6, there are shown a communication process on the music player MP side, i.e., the communication process (2), and a communication process on the PC 100 side. It should be noted that from the PC 100 side, the music player MP connected thereto via the USB cable is recognized as an external storage unit (storage), and the PC 100 can freely read and rewrite the stored content of the flash memory 13 of the music player MP.

Since the music player MP is extremely smaller in storage capacity than the PC 100, it is impossible for the music player MP (more specifically, the flash memory 13 thereof) to store all the music data (including the compressed audio performance files 13*dn*) in all the operation modes (in this embodiment, two types of operation modes are shown by way of example, but about ten types of operation modes are provided in actuality). Thus, an immediately necessary part of music data which are stored beforehand in the PC 100 is selected and stored in the flash memory 13. A determination to determine the presence or absence of the immediate necessity of respective music data, storage of necessary music data into the flash memory 13, elimination of unnecessary music data from the flash memory 13, renewal of the play list file 13*a*, and so on are all performed on the PC 100 side. To this end, the communication process between the PC 100 and the music player MP is required.

In the communication process on the PC 100 side, a CPU (not shown) of the PC 100 performs the following processes.

(101) A process to request the music player MP to transmit the personal information file 13*b*, and receive the transmitted file 13*b* (step S101);

(102) A process to acquire a tempo range in each operation mode from the personal information file 13*b* (step S102);

(103) A process to select music data in accordance with the tempo range in each operation mode acquired by the process (102) (step S103);

(104) A process to produce the music information file 13*c* and the play list file 13*a* in accordance with a result of selection by the process (103) (step S104); and (105) A process to renew the compressed audio performance files 13*dn*, the music information file 13*c*, and the play list file 13*a* in the music player MP (specifically, in the flash memory 13 thereof) (step S105).

In the music selection process (103), music data are selected according to the tempo range specified by the minimum and maximum tempo values indicated in the personal information for each operation mode. Here, the words "according to the tempo range" do not indicate that music data having a tempo even slightly deviating from the tempo range should not be selected, but indicate that music data may be selected with some margin, for example, about 10%. As a result, when the minimum tempo value of 90 bpm and the maximum tempo value of 140 bpm are indicated in the personal information, music data each having a tempo falling within the range from 81 bpm to 154 bpm are selected.

By the music selection process (103), music data to be registered in the play list are selected for each operation mode. In the process (104), the play list for each operation mode is produced, and all the play lists are combined together to thereby produce one play list file. Since there is always present meta data corresponding to each selected music data (meta data is produced simultaneously with acquisition of music data as described below with reference to FIG. 7, and the music selection process (103) is implemented based on the content of meta data made to correspond to each music data), all the meta data corresponding to respective ones of all the selected music data are combined together to produce one music information file. IDs attached to music data are also attached to meta data, thereby maintaining a one-to-one correspondence between each of the selected music data and the meta data corresponding thereto, even if the data save destination will be changed from the PC 100 side to the music player MP.

In response to a request for transmission from the PC 100 in the process (101), the CPU 8 of the music player MP transmits the personal information file 13*b* stored in the flash memory 13 to the PC 100 via the USB I/F 14 (step S21). In response to renewal of files in the process (105), the CPU 8 renews the compressed audio performance files 13*dn*, the music information file 13*c*, and the play list file 13*a*, which are stored in the flash memory 13 (step S22).

Figure 7:
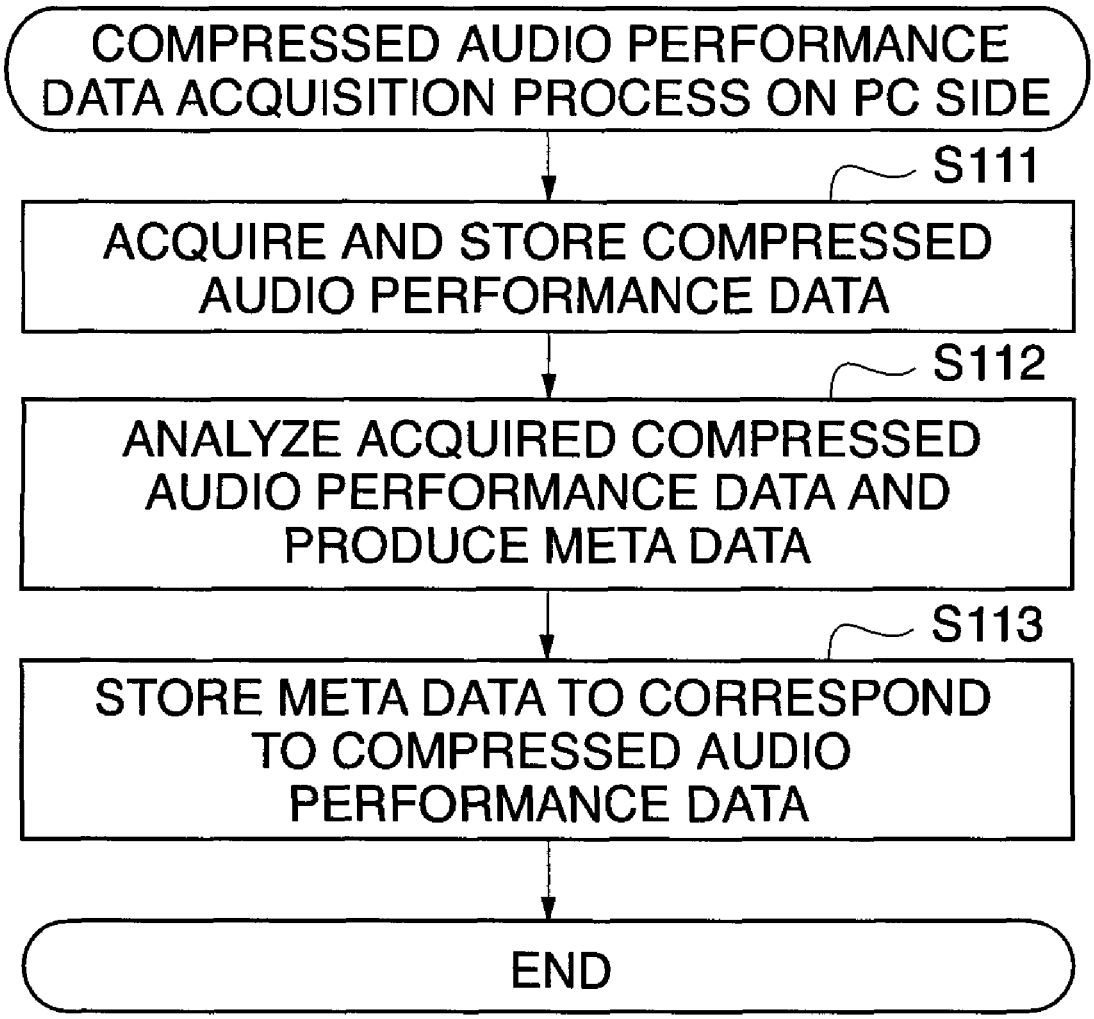
FIG. 7 is a flowchart showing the procedure performed on a PC side to acquire compressed audio performance data on which a compressed audio performance file is based.

FIG. 7 shows in flowchart the procedure of a process implemented by the PC 100 side to acquire compressed audio performance data on which the compressed audio performance files 13*dn* are based.

In accordance with, for example, a user's instruction, the CPU of the PC 100 acquires compressed audio performance data, and causes the acquired data to be stored into an external storage unit (not shown) such as an HDD (hard disk unit) (step S111). There may be several sources from which the compressed audio performance data are acquired. For example, a compressed audio performance data provider site on the Internet can be mentioned, which is of course not limitative. To acquire the compressed audio performance data, audio performance data obtained from the source of audio performance data (such as a music CD) can be compressed using software for compressing uncompressed audio performance data into compressed audio performance data.

Next, the CPU analyzes the acquired compressed audio performance data and produces meta data (step S112). Specifically, the CPU analyzes the compressed audio performance data to detect therefrom a main point, tempos, beat positions, fade positions, etc., and produces meta data having these parameters indicated therein. As a method for analyzing the compressed audio performance data, there can be mentioned, for example, a method in which the compressed audio performance data is signal-processed to detect a time-dependent change in sound volume or the periodicity of time-dependent change in sound volume, or in which such a detection is performed for signals having frequencies falling within a particular frequency range. In particular, by detecting the periodicity of sound volume change in a low-frequency range, bass drum beats or bass drum tempos can be detected. Alternatively, meta data can be produced or modified by the user, while listening to music sound reproduced from data obtained by expanding the compressed audio performance data.

Furthermore, the CPU causes the produced meta data to be stored in the external storage unit such as to correspond to the compressed audio performance data (step S113).

Referring to FIG. 5A again, in the process before the start of fitness exercise (3), the CPU 8 sets a stopgap measure in accordance with user's operation or initialization (step S4). As describe above, upon and after start of fitness exercise, a plurality of music pieces are sequentially selected and reproduced one by one. The "stopgap measure" set in step S4 is to bridge a transition from one piece of music to another. Since this invention is not characterized in the stopgap measure, a further explanation thereof is omitted.

Next, in accordance with user's operation or initialization, the CPU 8 sets the operation mode into either the walk mode or the jogging mode (step S5). As described previously, the walk mode is set in the initialization. Therefore, the operation mode is set into the walk mode, if the operation mode setting is not changed by the user. On the other hand, if the operation mode setting is changed by the user, the walk mode is changed to the jogging mode. As the method for changing the operation mode, there can be mentioned a method in which a menu is displayed on the LCD 12*a* when the menu button 3*d* is operated, and two options "walk mode" and "jogging mode" are displayed when an item for changing the operation mode is selected from the menu, thereby permitting the user to select either the "walk mode" or the "jogging mode". Of course, the method for changing the operation mode is not limited to the described method so long as the operation mode can be changed.

Furthermore, in accordance with user's operation or initialization, the CPU 8 sets either the play list 13*a*1 for walk use or the play list 13*a*2 for jogging use into the play list (step S6). As the method for the play list setting, a method similar to the method for changing the operation mode setting can be used. It should be noted that instead of positively setting the play list, it is possible to automatically set the play list corresponding to the operation mode when the operation mode is set.

When an instruction to start fitness exercise is given by the user by, for example, operating the menu button 3*d* (step S7), the CPU 8 causes the process to proceed to the processing at the start of fitness exercise (4). In this processing (4), the CPU 8 calculates an optimal heart rate curve based on the set operation mode (step S8). The optimal heart rate curve shown in FIG. 4 is calculated for a case where the jogging mode is set. The optimal heart rate curve represents a transition of heart rate from start to end of fitness exercise, which is optimum for the user performing fitness exercise in the set operation mode. The optimal heart rate curve varies between respective users, and therefore, must be calculated based on user information (such as age, exercise history, and physical condition). It should be noted that this invention is not characterized in a method for calculating the optimal heart rate curve, and the optimal heart rate curve can be calculated using any known method. Thus, an explanation of the calculation method is omitted herein.

Next, the CPU 8 initializes the target tempo to a minimum tempo value which varies according to the operation mode (step S9). The minimum tempo value is a minimum tempo value indicated in the personal information 13*b*1 or 13*b*2 of the personal information file 13*b*. In the example of FIG. 3, the initial value of the target tempo is set to 80 bpm when the walk mode is set. On the other hand, when the jogging mode is set, the initial value of target tempo is set to 140 bpm.

Next, the CPU 8 performs a music selection process to select music data having a tempo corresponding to the set target tempo (step S10).

Figure 8:
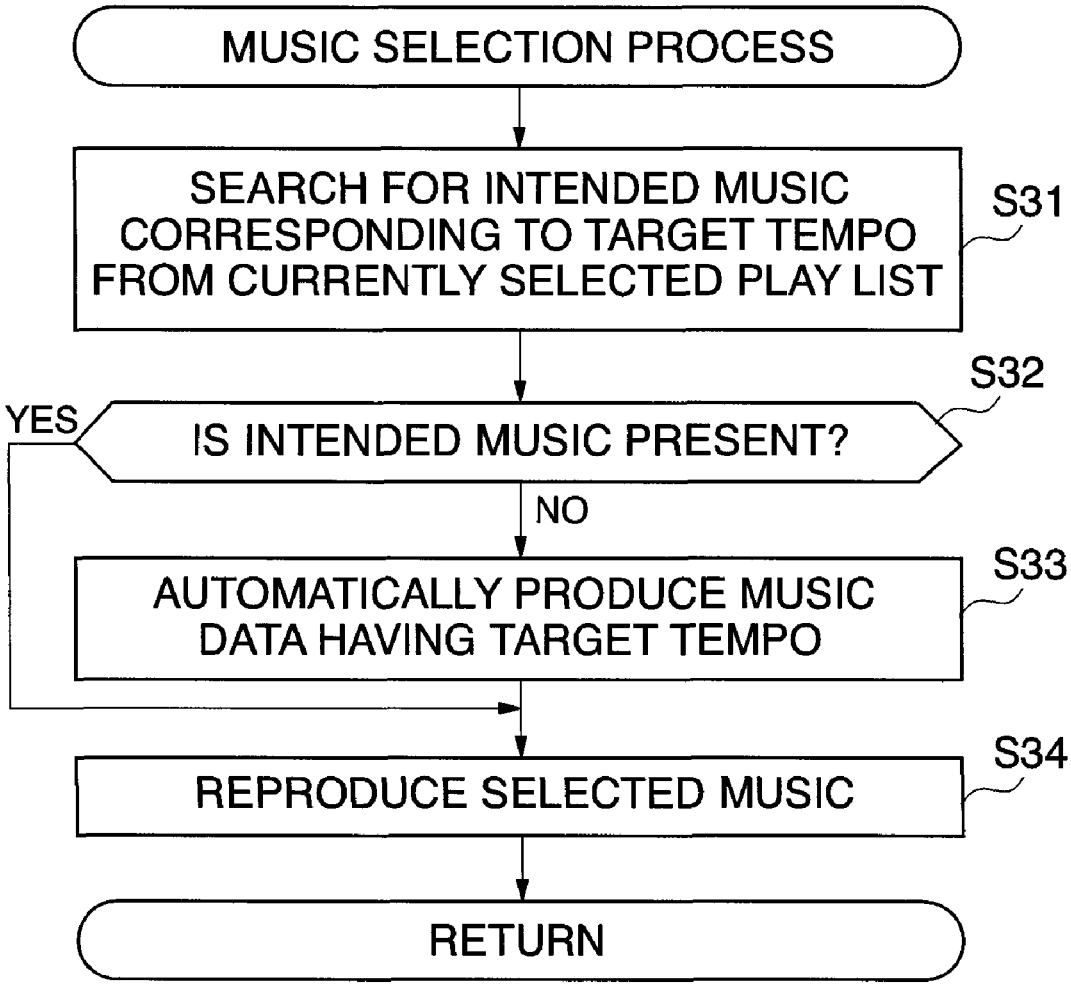
FIG. 8 is a flowchart showing in detail the procedure of a music selection process shown in FIG. 5B.

FIG. 8 shows in flowchart the detailed procedure of the music selection process.

In the music selection process, the CPU 8 searches for music having a tempo corresponding to the target tempo from the currently selected play list (step S31). Specifically, the CPU 8 accesses, one by one, pieces of meta data 13*cn* in music information file 13*c* which respectively correspond to pieces of music registered in the play list, and compares a main point value indicated in each of meta data 13*cn* with the target tempo value. If the main point value falls within a range in which the main point does not vary more than plus or minus 3% from the target tempo value, the music corresponding to the currently accessed meta data is determined as intended music. When a plurality of intended music are found, any of them is randomly selected and the selected music is finally determined as intended music, thereby preventing the same music from being always determined as the intended music.

As a result of the search in step S31, if it is determined that intended music is present, the CPU 8 gives an instruction to reproduce the music to the compressed audio decoder 16 (steps S32 and S34). On the other hand, if it is determined that intended music is not present, the CPU 8 automatically produces music data (MIDI data) having the target tempo (steps S32 and S33), and then instructs the MIDI tone generator circuit 15 to reproduce the produced MIDI data (step S34). This invention has a feature that, when music having a tempo corresponding to the target tempo is not registered in the play list, unlike the above described known performance apparatus in which any of music data registered in the play list is reproduced, with its original tempo forcibly made coincident with the target tempo, all new music data having a tempo corresponding to the target tempo is automatically produced and the produced music data is reproduced. All new music data (all new performance data) automatically produced is not based on the pre-stored performance data. This invention is not characterized by how music data having a tempo corresponding to the target tempo is automatically produced, and therefore, any known method for producing such music data can be used. As a technique for automatically producing all new performance data (MIDI data), it is known, for example, to select fragmentary phrases in accordance with a random number or the like from among fragmentary phrases stored beforehand for respective instrument parts in the MIDI format in the flash memory 13 or the like, combine the selected phrases together, and produce them in a designated tempo.

When the music selection process is completed, the CPU 8 causes the process to proceed to the fitness process (5). The fitness process (5) is continued until an instruction to terminate the fitness exercise is given by the user or until an estimated completion time of fitness exercise (see FIG. 4) is reached.

Figure 9:
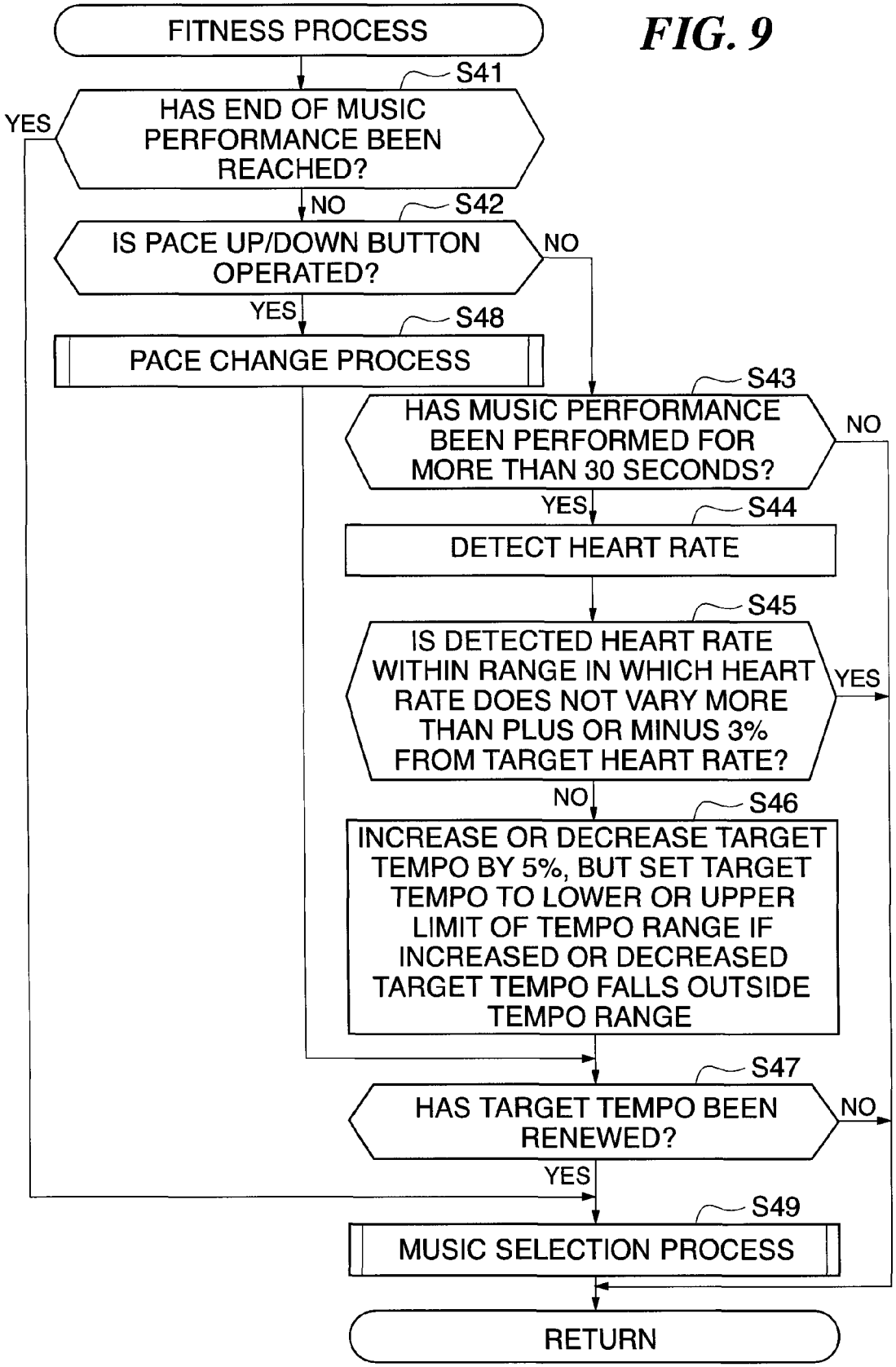
FIG. 9 is a flowchart showing in detail the procedure of a fitness process shown in FIG. 8.

FIG. 9 shows in flowchart the detailed procedure of the fitness process (5).

In the fitness process (5), the CPU 8 performs the following processes.

(21) A process for renewing the target tempo along the optimal heart rate curve (steps S44 to S46);

(22) A music selection process performed when the target tempo is renewed (steps S47 and S49);

(23) A pace change process performed when the pace up/down button 3*b* or 3*c* is operated (steps S42 and S48); and

(24) A music selection process performed when the end of music data performance has been reached (steps S41 and S49).

As described above, upon elapse of a predetermined time period (30 seconds in this embodiment) from the start of performance (playback) based on music data having a tempo corresponding to the target tempo (step S43), the CPU 8 causes the process to proceed to the target tempo renewal process (21). In this process (21), the CPU 8 detects user's pulse (heart rate) via the pulse detection circuit 5 (step S44). Next, the CPU 8 compares the detected heart rate with a target heart rate (a heart rate on the optimal heart rate curve at the time point of heart rate detection), and if the detected heart rate falls outside a range in which the heart rate does not vary more than plus or minus 3% from the target heart rate, the target tempo is increased or decreased by 5% (steps S45 and S46). Specifically, when the detected heart rate is more than 3% higher than the target heart rate, the current fitness exercise is too hard for the user, and the target tempo is decreased by 5% to decrease the load of the user. On the other hand, if the detected heart rate is more than 3% lower than the target heart rate, the current fitness exercise is too light for the user and the target tempo is increased by 5% to increase the load of the user. If, however, the target tempo falls outside a tempo range determined by the selected personal information (either the personal information 13*b*1 or 13*b*2) due to the increase or decrease in the target tempo, the target tempo is set to the lower or upper limit of the tempo range (the minimum or maximum tempo value). When the detected heart rate is within the range in which the hear rate does not vary more than plus or minus 3% from target heart rate (step S45), the target tempo is kept unchanged.

When the target tempo has been renewed by the target tempo renewal process (21), the CPU 8 causes the process to proceed to the music selection process (22) (steps S47 and S49). In this process (22), the CPU 8 performs the music selection process shown in FIG. 8, to thereby select music data having a tempo corresponding to the target tempo.

When the user operates the pace up/down button 3*b* or 3*c* during the fitness process, the CPU 8 causes the process to proceed to the pace change process (23).

Figure 10:
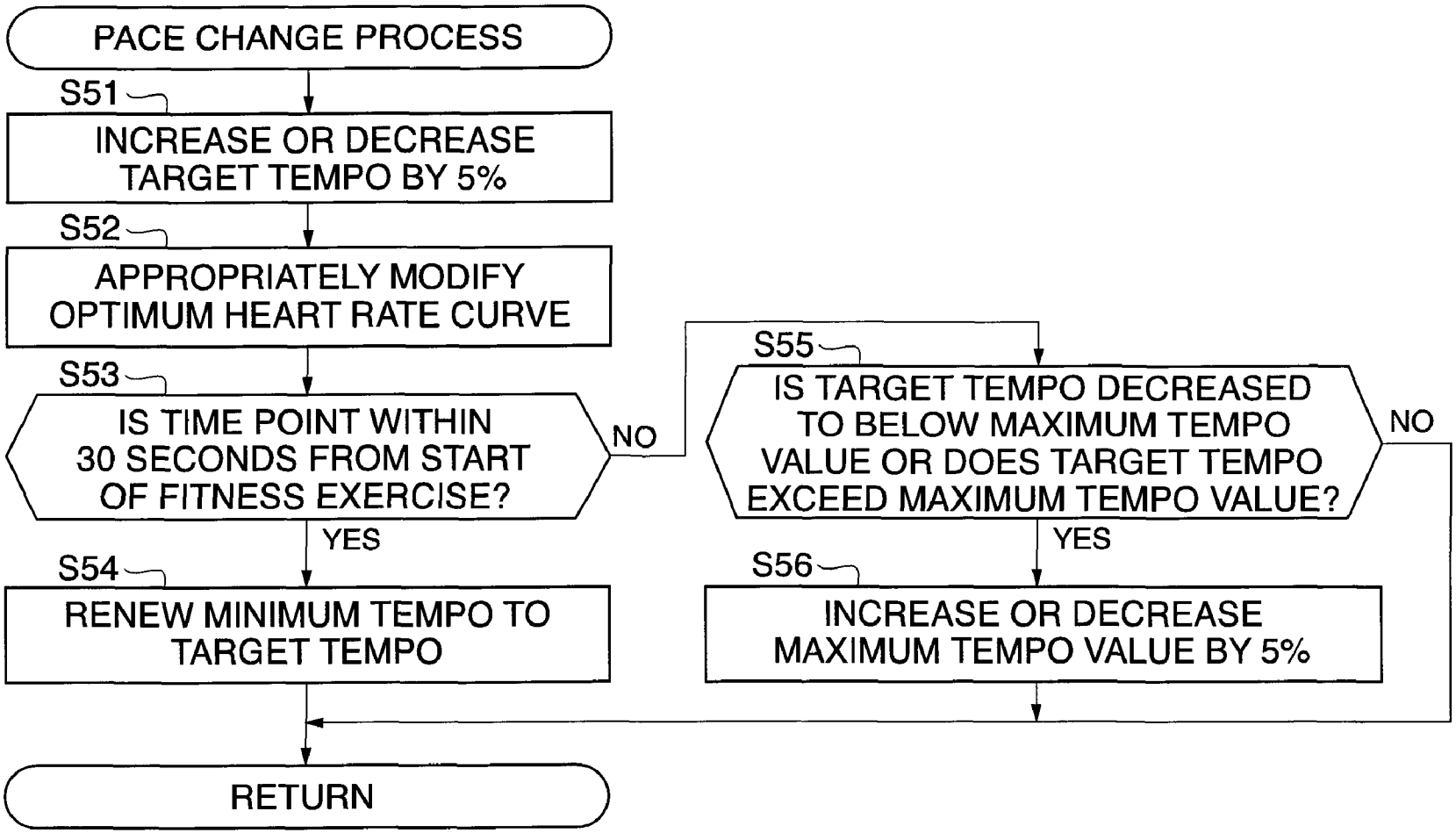
FIG. 10 is a flowchart showing in detail the procedure of a pace change process shown in FIG. 9.

FIG. 10 shows in flowchart the detailed procedure of the pace change process (23).

In the pace change process (23), when the pace-up button 3*b* is operated, the CPU 8 increases the target tempo by 5%. On the other hand, when the pace-down button 3*c* is operated, the target tempo is decreased by 5% (step S51).

Next, the CPU 8 appropriately modifies the shape of the optimal heart rate curve in accordance with the increase/decrease in target tempo (step S52). The words "appropriately modify" implies that the shape of the optimal heart rate curve may not be modified. In such a case, even if the user operates the pace up/down button 3*b* or 3*c* so as to increase or decrease the target tempo and musical performance is performed based on music data having a tempo corresponding to the increased or decreased target tempo, the target heart rate per se remains the same as a value on the original optimal heart rate curve. As a result, the target tempo is gradually made close to the target tempo determined based on the original optimal heart rate curve, i.e., the target tempo for the case that the pace up/down button 3*b* or 3*c* is not operated, whereas a state is continued where the detected heart rate varies more than plus or minus 3% from the target heart rate. In other words, even if the pace up/down button 3*b* or 3*c* is operated and the target tempo is renewed, the renewed target tempo is only temporarily maintained. When the pace up/down button 3*b* or 3*c* is operated and the target tempo is renewed, therefore, it is preferable that the shape of the optimal heart rate curve should also be modified accordingly. The degree of modification of the curve shape may be a 5% increase or decrease similarly to the degree of modification of the target tempo, but may be greater or smaller than 5%. In addition, the degree of modification can be varied according to a time period for which the fitness exercise has been performed.

Next, the CPU 8 determines whether or not a time point at which an instruction to increase or decrease the target tempo has been given by the pace up/down button 3*b* or 3*c* is within 30 seconds from the start of the fitness exercise. If so, the minimum tempo value in the currently set operation mode is renewed to the increased or decreased target tempo value (steps S53 and S54). Specifically, in the case that the jogging mode is currently set and the initial value of target tempo has been set at 140 bpm, when the pace-down button 3*c* is operated by the user within 30 seconds from the start of fitness exercise, the target tempo is changed to 133 bpm (5% smaller than 140 bpm), and the minimum tempo value of the personal information 13*b*2 is made equal to the changed target tempo of 133 bpm. As a result, the minimum tempo value of the personal information 13*b*2 is renewed from 140 bpm to 133 bpm. It should be noted that the minimum tempo value of the personal information 13*b*2 is not immediately renewed by the processing in step S54 but temporarily renewed. The renewal is fixed upon receipt of user's approval in the processing in step S14 described below.

When the pace-down button 3*c* is operated by the user and the target tempo is decreased to below the maximum tempo value after elapse of more than 30 seconds from the start of fitness exercise or when the pace-up button 3*b* is operated and the target tempo exceeds the maximum tempo value, the maximum tempo value in the operation mode currently set is renewed by the CPU 8 to the increased or decreased target tempo value (steps S55 and S56). More specifically, in the state that the jogging mode has been set and the target tempo has been set to 190 bpm, when the pace-down button 3*c* is operated by the user, the target tempo is changed to 181 bpm (5% smaller than 190 bpm), and the maximum tempo vale of the personal information 13*b*2 is made equal to the changed target tempo of 181 bpm. As a result, the maximum tempo value of the personal information 13*b*2 is renewed from 190 bpm to 181 bpm. It should be noted that the maximum tempo value of the personal information 13*b*2 is not immediately renewed by the processing in step S56 but temporarily renewed. The renewal is fixed upon receipt of user's approval in the processing in S14.

When the target tempo has been changed by the pace change process (23) as described above, the CPU 8 subsequently performs the music selection process in step S49.

When the end of the musical performance based on the selected music data is reached, the CPU 8 causes the process to proceed to the music selection process (24). In this process (24), the CPU 8 performs the music selection process shown in FIG. 8, thereby selecting music data having a tempo corresponding to the target tempo.

Referring to FIG. 5B again, when the fitness process (5) is finished (step S12), the CPU 8 causes the process to proceed to the process upon completion of fitness exercise (6). In this process (6), when the maximum or minimum tempo value indicated in the personal information has been changed, the CPU 8 writes the content of change into the corresponding personal information in the personal information file 13*b* upon receipt of user's approval (steps S13 and S14).

In this embodiment, the music selection process is performed each time the target tempo is renewed by the pace changing operation. However, since a frequent change of music is unnatural and impractical, it is preferable that the change of music should be prohibited until 30 seconds have elapsed from the preceding change of music.

It is to be understood that the present invention may also be accomplished by supplying a system or an apparatus with a storage medium in which a program code of software, which realizes the functions of the above described embodiment is stored, and causing a computer (or CPU or MPU) of the system or apparatus to read out and execute the program code stored in the storage medium.

In this case, the program code itself read from the storage medium realizes the novel functions of the present invention, and hence the program code and a storage medium on which the program code is stored constitute the present invention.

Examples of the storage medium for supplying the program code include a flexible disk, a hard disk, a magneto-optical disk, an optical disk such as a CD-ROM, a CD-R, a CD-RW, a DVD-ROM, a DVD-RAM, a DVD-RW, or a DVD+RW, a magnetic tape, a nonvolatile memory card, and a ROM. Alternatively, the program code may be downloaded from a server computer via a communication network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided in an expansion board inserted into a computer or a memory provided in an expansion unit connected to the computer and then causing a CPU or the like provided in the expansion board or the expansion unit to perform a part or all of the actual operations based on instructions of the program code.

This application is based on, and claims priority to, Japanese Patent Application No. 2007-085508, filed on 28 Mar. 2007. The disclosure of the priority application, in its entirety, including the drawings, claims, and the specification thereof, is incorporated herein by reference.

What is claimed is:

1. A portable performance apparatus for use by a user during fitness exercise, the apparatus comprising:

a storage unit adapted to store a plurality of audio data;

a setting unit adapted to set a target tempo;

a search unit adapted to, from among the plurality of audio data stored in said storage unit, search for intended audio data having a tempo falling within a predetermined range including the target tempo set by said setting unit;

a selection unit adapted to, if the intended audio data has been searched by said search unit, select the intended audio data, and adapted to, if the intended audio data has not been searched, produce all new MIDI data having a tempo corresponding to the set target tempo and select the produced MIDI data; and a reproduction unit adapted to reproduce the audio data or the MIDI data selected by said selection unit;

wherein said setting unit, said search unit, said selection unit and said reproduction unit are adapted to be operated during the user's fitness exercise.

2. The performance apparatus according to claim 1, including:

a measurement unit adapted to measure a heart rate of a user, wherein said setting unit is adapted to set the target tempo based on the heart rate measured by said measurement unit.

3. A portable performance apparatus for use by a user during fitness exercise, the apparatus comprising:

a transmitter-receiver unit adapted to transmit and receive data to and from an external device connected thereto;

a notification unit adapted to notify the external device of a tempo range via said transmitter-receiver unit;

a storage unit adapted to receive audio data from the external device via the transmitter-receiver unit and store the received audio data;

a setting unit adapted to set a target tempo;

a search unit adapted to search for, from among a plurality of audio data stored in said storage unit, intended audio data having a tempo falling within a predetermined range including the target tempo set by said setting unit;

a selection unit adapted to, if the intended audio data has been searched by said search unit, select the intended audio data, and adapted to, if the intended audio data has not been searched, produce all new MIDI data having a tempo corresponding to the set target tempo and select the produced MIDI data;

a reproduction unit adapted to reproduce the audio data or the MIDI data selected by said selection unit; and a tempo range changing unit adapted to change the tempo range;

wherein said transmitter-receiver unit, said notification unit and said storage unit are adapted to be operated during communication with the external device; and wherein said setting unit, said search unit, said selection unit, said reproduction unit and said tempo range changing unit are adapted to be operated during the user's fitness exercise.

4. The performance apparatus according to claim 3, including:

a target tempo changing unit adapted to change the set target tempo in accordance with an instruction given by user's operation, wherein said tempo range changing unit is adapted to change the tempo range when the target tempo changed by said target tempo changing unit falls outside the tempo range.

5. The performance apparatus according to claim 3, including:

a measurement unit adapted to measure a heart rate of a user, wherein said setting unit is adapted to set the target tempo based on the heart rate measured by said measurement unit.

6. A non-transitory computer-readable storage medium storing a program for causing a computer to execute a method for controlling a portable performance apparatus for use by a user during fitness exercise, including a storage unit, the method comprising:

a setting step of setting a target tempo;

a search step of searching for, from among a plurality of audio data stored in the storage unit, intended audio data having a tempo falling within a predetermined range including the target tempo set in said setting step;

a selection step of selecting the intended performance data, if the intended audio data has been searched in said search step, said selection step producing all new MIDI data having a tempo corresponding to the set target tempo and selecting the produced MIDI data, if the intended audio data has not been searched; and a reproduction step of reproducing the audio data or the MIDI data selected in said selection step;

wherein said setting step, said search step, said selection step and said reproduction step are performed during the user's fitness exercise.

* * * * *